US010030850B2

(12) United States Patent
Vissenberg et al.

(10) Patent No.: US 10,030,850 B2
(45) Date of Patent: Jul. 24, 2018

(54) ILLUMINATION DEVICE AND LUMINAIRE

(75) Inventors: Michel Cornelis Josephus Marie Vissenberg, Roermond (NL); Antonius Petrus Marinus Dingemans, Tilburg (NL); Marcus Jozef Van Bommel, Waalre (NL); Erik Paul Boonekamp, Utrecht (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 44 days.

(21) Appl. No.: 13/825,338

(22) PCT Filed: Sep. 19, 2011

(86) PCT No.: PCT/IB2011/054084
§ 371 (c)(1),
(2), (4) Date: Mar. 21, 2013

(87) PCT Pub. No.: WO2012/042429
PCT Pub. Date: Apr. 5, 2012

(65) Prior Publication Data

US 2013/0201690 A1 Aug. 8, 2013

(30) Foreign Application Priority Data

Sep. 30, 2010 (EP) ..... 10182952

(51) Int. Cl.
*F21V 7/00* (2006.01)
*F21V 1/00* (2006.01)
(Continued)

(52) U.S. Cl.
CPC ..... *F21V 7/22* (2013.01); *E04B 9/0464* (2013.01); *E04B 9/34* (2013.01); *F21S 8/04* (2013.01);
(Continued)

(58) Field of Classification Search
CPC .. F21S 8/04; F21S 8/046; F21V 7/008; F21V 7/0033; F21V 7/0041; F21V 7/0025;
(Continued)

(56) References Cited

U.S. PATENT DOCUMENTS 2,715,449 A 8/1955 Lemmerman et al.
2,759,094 A * 8/1956 Goddard et al. ..... 362/247
(Continued)

FOREIGN PATENT DOCUMENTS

CN 101266030 A 9/2008
DE 102007054206 A1 4/1996
(Continued)

OTHER PUBLICATIONS

"Thermal Conductivity of some common Materials and Gases" accessed at http://www.engineeringtoolbox.com/thermal-conductivity-d_429.html on Nov. 13, 2014.*
(Continued)

*Primary Examiner* — Erin Kryukova

(57) ABSTRACT

Today the use of false ceilings is decreasing as it involves too high an energy consumption. The tendency nowadays is to have bare concrete ceilings onto which luminaires are mounted, which often causes acoustical problems. The invention deals with these acoustical problems and relates to an illumination device (1) comprising a concave reflector (2) bordering, with an outer edge (3), on a light emission window (4). The reflector has a reflective surface (7) facing the light emission window. The illumination device further comprises lamp holding means (8) for accommodating a light source (9), and said lamp holding means being positioned in between the reflective surface and the light emission window. The illumination device is characterized in that the reflector is made of acoustically absorbing material.

9 Claims, 4 Drawing Sheets

(51) Int. Cl.

| | |
|---|---|
| ***F21V 5/00*** | (2015.01) |
| ***F21S 8/00*** | (2006.01) |
| ***F21S 6/00*** | (2006.01) |
| ***F21V 7/22*** | (2018.01) |
| ***E04B 9/04*** | (2006.01) |
| ***E04B 9/34*** | (2006.01) |
| ***F21S 8/04*** | (2006.01) |
| ***F21V 33/00*** | (2006.01) |
| *F21V 9/16* | (2006.01) |
| *F21S 8/06* | (2006.01) |
| *F21Y 103/10* | (2016.01) |
| *F21Y 115/10* | (2016.01) |
| *F21Y 113/13* | (2016.01) |

(52) U.S. Cl.

CPC ..... *F21V 33/006* (2013.01); *F21S 8/061* (2013.01); *F21V 5/002* (2013.01); *F21V 7/005* (2013.01); *F21V 7/0083* (2013.01); *F21V 9/16* (2013.01); *F21Y 2103/10* (2016.08); *F21Y 2113/13* (2016.08); *F21Y 2115/10* (2016.08)

(58) Field of Classification Search

CPC ..... F21V 17/00; F21V 17/002; F21V 17/04; F21V 17/06; F21V 17/082; E04B 9/006; E04B 1/8209; E04B 2001/8414; E04B 31/8209; E04B 9/00; E04B 1/99; G10K 11/16

USPC ..... 362/217.05, 217.07, 217.1, 296.01, 362/296.05, 296.07, 341, 347, 147, 148, 362/346

See application file for complete search history.

(56) References Cited

U.S. PATENT DOCUMENTS

| | | | | | |
|---|---|---|---|---|---|
| 2,854,565 | A * | 9/1958 | Kruger | E04B 9/32 | 362/150 |
| 2,978,571 | A * | 4/1961 | Rosenblatt | E04B 9/32 | 181/289 |
| 2,993,802 | A * | 7/1961 | Cascone | B29C 70/12 | 162/129 |
| 3,094,285 | A * | 6/1963 | Kruger | E04B 9/02 | 362/150 |
| 3,270,194 | A * | 8/1966 | Lee | F21V 7/0016 | 355/119 |
| 3,321,877 | A * | 5/1967 | Alexieff | 52/144 | |
| 3,512,313 | A * | 5/1970 | Harz | E04B 9/12 | 362/150 |
| 3,591,794 | A | 7/1971 | Dail et al. | | |
| 3,922,073 | A | 11/1975 | Schwartz | | |
| 4,794,501 | A * | 12/1988 | Bartenbach | F21V 7/0008 | 362/217.03 |
| 4,829,728 | A * | 5/1989 | Castelli | 52/145 | |
| 5,128,848 | A * | 7/1992 | Enders et al. | 362/268 | |
| 5,195,818 | A * | 3/1993 | Simmons et al. | 362/224 | |
| 5,357,413 | A * | 10/1994 | Mandall | F21V 7/0008 | 362/300 |
| 5,521,801 | A * | 5/1996 | Pesau | F21V 7/0016 | 362/147 |
| 5,782,551 | A | 7/1998 | Capaul | | |
| 5,988,829 | A * | 11/1999 | Holder | F21S 8/02 | 362/147 |
| 5,988,836 | A * | 11/1999 | Swarens | 362/364 | |
| 6,367,581 | B1 * | 4/2002 | Marler | B66B 11/0226 | 181/295 |
| 6,558,032 | B2 * | 5/2003 | Kondo et al. | 362/516 | |
| 6,641,293 | B2 * | 11/2003 | Kumar et al. | 362/539 | |
| 6,758,582 | B1 * | 7/2004 | Hsiao et al. | 362/302 | |
| 6,851,834 | B2 * | 2/2005 | Leysath | F21S 8/04 | 362/240 |
| 7,178,943 | B2 * | 2/2007 | Holten | 362/245 | |
| 7,303,305 | B2 | 12/2007 | Kennedy | | |
| 7,726,848 | B2 * | 6/2010 | Lai | 362/300 | |
| 8,287,146 | B2 * | 10/2012 | Hysky | 362/234 | |
| 2002/0003699 | A1 * | 1/2002 | Shemitz et al. | 362/225 | |
| 2002/0024818 | A1 * | 2/2002 | Kondo et al. | 362/516 | |
| 2003/0117798 | A1 * | 6/2003 | Leysath | 362/248 | |
| 2004/0037088 | A1 * | 2/2004 | English et al. | 362/545 | |
| 2004/0213003 | A1 * | 10/2004 | Lauderdale et al. | 362/404 | |
| 2006/0198146 | A1 * | 9/2006 | Lippis | E04B 9/006 | 362/277 |
| 2008/0130295 | A1 * | 6/2008 | Ueda | F21V 7/22 | 362/346 |
| 2008/0247171 | A1 * | 10/2008 | Tyson | F21V 13/04 | 362/299 |
| 2009/0173570 | A1 * | 7/2009 | Levit | E04B 9/04 | 181/286 |
| 2010/0097794 | A1 * | 4/2010 | Teng et al. | 362/231 | |
| 2010/0110674 | A1 | 5/2010 | Hysky | | |
| 2010/0135013 | A1 * | 6/2010 | Chiang | F21V 7/005 | 362/235 |
| 2010/0182782 | A1 | 7/2010 | Ladewig | | |
| 2010/0296281 | A1 * | 11/2010 | Hofmann | 362/235 | |
| 2011/0043132 | A1 * | 2/2011 | Kim | F21S 8/026 | 315/294 |
| 2011/0058358 | A1 * | 3/2011 | Soo et al. | 362/147 | |
| 2012/0147603 | A1 * | 6/2012 | Hochstein | F21V 29/004 | 362/247 |
| 2012/0307483 | A1 * | 12/2012 | Wassel et al. | 362/184 | |

FOREIGN PATENT DOCUMENTS

| | | | |
|---|---|---|---|
| DE | 19608583 | A1 | 9/1996 |
| DE | 19620659 | A1 | 11/1997 |
| DE | 202009004252 | U1 | 5/2010 |
| EP | 2163701 | A1 | 3/2010 |
| FR | 1558925 | A1 | 3/1969 |
| GB | 593235 | A | 10/1947 |
| WO | 199829683 | | 7/1998 |

OTHER PUBLICATIONS

"Illbruck Acoustic—Noise Control that Works", dated 2006 and accessed from http://www.gvsafety.com/Documents/SAFETY%20HANDOUTS/Noise%20Control/Illbruck%20Acoustic-Noise%20Control%20that%20Works.pdf on Jul. 18, 2016.*

* cited by examiner

ILLUMINATION DEVICE AND LUMINAIRE

FIELD OF THE INVENTION

The invention relates to an illumination device comprising:

- a concave reflector bordering, with an outer edge, on a light emission window, the reflector and the light emission window constituting a boundary of a reflector cavity, and the reflector having a reflective surface facing the light emission window;
- lamp holding means for accommodating a light source and being provided at or within the boundary of the reflector cavity.

The invention further relates to a luminaire comprising at least one illumination device according to the invention.

BACKGROUND OF THE INVENTION

Such an illumination device is known from U.S. Pat. No. 5,782,551. The known illumination device is a luminaire that is mounted with a backside to a deck. An acoustical shell, which acts as a reflector and which can produce an office light beam with conventional louver optics, is provided at the backside of the luminaire. Said acoustical shell is made such that it allows sound to pass through to an absorbing blanket provided in between the acoustical shell and the deck. To this end the acoustical shell is made from perforated metal material or molded, high-density fiberglass material. The acoustical shell and the absorbing blanket thus form a stack of an optical element and an acoustically absorbing element. This causes the known luminaire to have the disadvantages of being relatively expensive, involving laborious mounting, and having a relatively complicated and rather bulky construction.

SUMMARY OF THE INVENTION

It is an object of the invention to provide an illumination device of the type as described in the opening paragraph, in which at least one of the abovementioned disadvantages is counteracted. To achieve this the illumination device of the type as described in the opening paragraph is characterized in that the reflector is made of acoustically absorbing material. As the same element is used for both reflection of light and absorption of sound, a reduction in size, thickness and/or width and costs compared to the conventional solutions with stacked optical and acoustic elements is attained. In principle any light reflective, sound absorbing material can be applied to form the reflector, for example cotton wadding wound around and carried by a rigid frame. However, preferably the sound absorbing material should have properties typical for reflectors, i.e. highly reflective to light, sufficient mechanical strength, heat and/or flame resistant etc. In this respect, heat resistant means that the material as such should be able to withstand a continuous service temperature of at least 120° C. during 30 days, and flame resistant, in this respect, means that the material as such does not propagate a flame. In particular, the sound absorbing material preferably is sufficiently rigid for example not to deform due to its own weight, and sufficiently rigid to be able to carry (small) light sources, and maintain its preformed optical shape throughout its lifetime under specified thermal and environmental conditions.

Preferably, the reflector is diffusely reflective or has at least a highly diffusive reflection component, for example in that the reflector is more than 70% or 80% or preferably 95% or more diffusely reflective and/or less than 30% or 20% or 5% or even less specularly reflective. Diffuse reflectors allow porous, open, or rough structures which are better suited for the absorption of sound than closed, smooth surfaces which are better suited for use as specularly reflective surfaces. Furthermore, diffusely reflective surfaces reduce the risk of glare, which is of particular importance in office lighting and for working with computers, and diffusely reflective surfaces are particularly suitable in environments where accurate beams, such as required for spotlighting, are somewhat less critical. Yet, if specularly reflective surfaces are desired, the acoustically absorbing material can be coated with a reflective metal coating, for example an aluminum coating. For a semi-specularly reflective reflector, a coating of satinized, white paint on the sound-absorbing material is appropriate.

Known materials that have at least one of the abovementioned properties are Basotect® from BASF, a flexible, lightweight, sound-absorbing, open-cell foam made from melamine resin, which is a thermoset/thermo-formable polymer with a reflectivity of about more than 85% depending on the applied coating, and GORE™ DRP® reflector material from Gore, a microporous structure made from durable, non-yellowing polymer PTFE (poly-tetra-fluoro-ethylene) with a reflectivity of about more than 99%.

The reflector can be in one piece, but alternatively the reflector can be made up of several reflector parts which together form the concave reflector, for example two oppositely positioned, elongated reflector halves with each a paraboloidally curved cross-section, or a curved, cup-shaped central part with a circumferential straight-shaped flange. The several parts could be held together, for example by a bridging element or by a housing in which the reflector parts are mounted. The bridging element or the housing could simultaneously serve as a means to hold the lamp-holding means, and to hold connector means to connect the illumination device to the mains power supply. In this invention, the expression "the lamp-holding means being provided at or within the boundary of the reflector cavity" comprises those embodiments in which said holding means, optionally together with the light source, form part of the boundary of the reflector cavity and/or are provided inside the reflector cavity.

The concave shape of the reflector has both optical and acoustic benefits: optically it contributes to the creation of a desired cut-off, such that the bright light source cannot be viewed at an angle smaller than a desired, specific angle; and acoustically, the concave shapes of reflectors reduce the acoustic impedance step from air to the absorbing material. As a result, the sound waves are less reflected by the material, and more sound is absorbed compared to a planar, flat plate. This benefit goes in particular for an array of reflectors. Also, this benefit is most apparent for sound waves with a wavelength comparable to the individual reflector size or larger. Another benefit of the concave shape compared to the planar, flat shape is that reflected sound is scattered more in space. This also improves the acoustic performance, as diffused sound is less intelligible and not clearly coming from a single direction, which is experienced as less disturbing.

The optically reflective side of the reflector preferably is convex, but the backside need not necessarily be concave, i.e. the backside may have any shape, for example undulated or flat. It is advantageous for the acoustic absorption to have more volume of the absorbing material. Therefor, preferably all void spaces in the luminaire are filled with the acoustically absorbing material. The acoustic material could have a constant thickness, but alternatively this is not the case: the whole housing, except for the space needed for the light source and driver, could be filled to improve the sound absorbing characteristics of the luminaire, although a balance between weight and costs of the illumination device on the one hand and sound absorbing characteristics of the illumination device on the other hand must be sought.

An embodiment of the illumination device is characterized in that the reflector is tapered and comprises an edge wall interconnecting a narrow end of width $W_{oe}$ and a wide end of width $W_{le}$ of the reflector, a height H of the tapered reflector being a dimension measured substantially parallel to an axis A of the tapered reflector, and the relationship between $W_{lw}$, $W_{oe}$, and H being according to the following equation:

$$\tan(\alpha)<=(W_{lw}+W_{oe})/2H,$$

with $\alpha$ is <=65°.

$\alpha$ is the (cut-off) angle between the axis A vertical to the light emission window and the line at which light source and/or surfaces of high luminance are not visible anymore through the light emission window. Preferably, the light source comprises a light-emitting surface being arranged at a narrow end of the tapered reflector, said light-emitting surface facing towards the light emission window and having a dimension substantially equal to a dimension of the narrow end of the tapered reflector, and being used for emitting substantially diffuse light towards a wide end of the tapered reflector. The light source then closes the narrow end, thus counteracting the possibility of an optic gap through which light may leak, and additionally enables a lower peak value of the light intensity while the same amount of light may still be issued from the illumination system. The glare cut-off is then determined by the height of the concave reflector in combination with the beam profile of the side-emitting source. The reflector should block a direct view into this beam. The given minimum height value renders the glare value of the illumination system acceptably low.

The axis of the tapered reflector is typically arranged so as to extend from the center of the narrow end to the center of the wide end and, for example, coincides with an optical axis of the illumination system. The axis intersects the light emission window; the intersection between the axis and the light emission window may, for example, be substantially perpendicular. The tapered reflector may have a truncated cone shape or a truncated pyramid shape or any other shape. The intersection between the edge of the wide end and/or narrow end and the light emission window may be circular, elliptical or polygonal. Especially tapered reflectors having an elliptical or rectangular shape of the intersection may be useful in corridor lighting, in which the beam profile could be made asymmetric either to enhance the wall illumination, for example wide beam to the walls, narrow beams parallel to the walls to avoid glare, or conversely, the beam could be made narrower towards the walls, to save energy, and wider along the corridor to increase luminaire spacing and save cost. The edge wall is made of (diffusely) reflecting material which typically has a reflectivity of 80% to 99.5%. The tapered reflector according to the invention may be embodied with or without a neck at its narrow end; the narrow end may be open or closed, in which latter case the tapered reflector is a concave reflector cup.

A further effect of the illumination system according to the invention is that the solution for generating an illumination system complying with the glare requirements is relatively cost-effective. Often, in known illumination systems, prismatic plates/sheets are used to limit the glare value. Such prismatic sheets are relatively expensive and the application of prismatic sheets in the known illumination systems is relatively expensive. Also the placement of louvers for limiting the glare for, for example, fluorescent light sources, is relatively time-consuming and thus relatively expensive. The tapered reflectors may be produced relatively cost-effectively, for example, from highly diffusely reflective foam and are shaped using, for example, thermo-forming processes. The tapered reflector may be arranged around the light source for generating at relatively low cost the illumination system having a limited glare value.

An embodiment of the illumination device is characterized in that it comprises a mixing chamber which is bound by the edge wall, the narrow end and an optical element provided in the reflector cavity and extending transversely to the axis. Thus, light from a plurality of LEDs, for example blue, green, red, amber or white emitting LEDs (forming the light source) is mixed, before being issued from the illumination device. The optical element may be a refractive element to redirect the light from the light source, or may be a lens to create special beam patterns, or may be provided with a luminescent material and/or the optical element is a scattering element. A benefit of this latter embodiment is that the combination of the light source and the scattering element allows choosing the level of diffusion of the light issued by the illumination device. The level of scattering may be adapted by, for example, replacing one scattering element with another. The use of scattering elements allows an optical designer to adapt, for example, the minimum height of the tapered reflector. The scattering elements may comprise diffuse scattering means for diffusely scattering the light from the light source. Due to such diffuse scattering means, the brightness of the light source is reduced to prevent users from being blinded by the light when looking into the illumination system. The diffuse scattering means may be a partly diffusely reflective and partly diffusely translucent diffuser plate, diffuser sheet or diffuser foil. The visibility of discrete LEDs, each issuing light of a specific spectrum, and hence the visibility of non-uniform light is thus effectively counteracted.

The scattering element may comprise holographic scattering structures for diffusely scattering the light from the light source. The efficiency of holographic scattering structures is much higher compared to other known scattering elements, allowing the emission of diffuse light from the light source, while maintaining a relatively high efficiency of the light source. The high efficiency is typically due to the relatively low back-scattering of the holographic scattering structure.

If the optical element comprises a luminescent material embedded in the optical element or applied to a surface of the optical element, the luminescent material may be beneficially used to adapt a color of the light emitted by the illumination system by converting light emitted by the light source to light of a different color. When, for example, the light source emits ultraviolet light, the optical element may comprise a mixture of luminescent materials which each absorb ultraviolet light and convert the ultraviolet light to visible light. The specific mixture of luminescent materials provides a mixture of light of a predefined perceived color. Alternatively, the light source emits visible light, for example, blue light, and part of the blue light is converted by luminescent material into light of a longer wavelength, for example, yellow light. When mixed with the remainder of the blue-light, light of a predefined color, for example, white light may be generated.

Especially when applying a coating or layer of luminescent material to a surface of the optical element facing the light source, the coating or layer of luminescent material is not immediately visible from the outside of the illumination system. In the example in which the light source emits blue light, a part of which is converted by the luminescent material to yellow light, the color of the luminescent material performing this conversion is perceived as yellow. When the luminescent material is visible from the outside of the illumination system, the sight of this yellow luminescent material (which may, for example, be the luminescent material: YAG:Ce) may not be preferred by a manufacturer of the illumination system as it may confuse users of the illumination system, causing them to think the illumination system emits yellow light. Therefore, when applying the luminescent material at the surface of the optical element facing towards the light source, the luminescent material is not directly visible from the outside, thus reducing the yellow appearance of the optical element and hence the confusion to users of the illumination system. Furthermore, the risk is reduced that the coating of luminescent material is damaged, for example by being scratched or wiped-off, when it is not exposed to the environment.

A shape of the light beam as emitted by the illumination system depends on, amongst others, the shape of the tapered reflector. A shape of the tapered reflector which generates a specific predefined beam shape may be determined using, for example, optical modeling software, also known as ray-tracing programs, such as LightTools®. For this purpose, an embodiment of the illumination device is characterized in that the edge wall is curved along the axis for adapting a beam shape of the light emitted by the illumination system. In an embodiment of the illumination device, the light emitting surface of the light source is convexly shaped towards the wide end of the tapered reflector. A benefit of such convex-shaped light emitting surfaces is that these light emitting surfaces may be more uniformly lit by a light source having, for example, a Lambertian light distribution, for example, light emitting diodes. Such improved uniformity further reduces the brightness of the diffuse light emitted by the light source, thereby further reducing glare.

A further benefit of the convex-shaped light emitting surface is that it provides space for the light source, which eases the manufacturing of the illumination system according to the invention. When the light source is, for example, a light emitting diode, the light emitting diode is typically applied to a circuit board such as a PCB. This PCB may be used to mount both the tapered reflector and the convex-shaped light emitting surface, thus enhancing the ease of manufacturing the illumination system. In addition, the convex-shaped light-emitting surface may provide space, at its reverse side, for driver electronics for the light source.

In an embodiment of the illumination system, the edge wall is curved inward towards the symmetry axis of the tapered reflector for adapting a beam shape of the light emitted by the illumination system. A benefit of this inwardly curved edge wall is that the glare value at 65 degrees is significantly decreased. This reduced glare value allows introducing a higher light flux in the illumination system having inwardly curved edge walls, compared to illumination systems having substantially straight edge walls, while still observing the glare norm. The exact curvature required of the edge wall may depend on the shape and size of the light emitting surface of the light source and may be determined using, for example, optical modeling software, also known as ray-tracing programs, such as ASAP®, LightTools®, etc.

In another embodiment, the illumination device is characterized in that the lamp holding means is provided in between a counter reflector and the reflective surface. The counter reflector can be chosen such that, in operation, the illumination device functions as a luminaire which issues light essentially solely in an indirect way, i.e. light from the light source is essentially only issued from the luminaire after being (diffusely) reflected. The effect of the counter reflector is two-fold, i.e., firstly it blocks a direct view, by an observer, of the light source through the light emission window, and secondly light emitted by the light source and impinging directly on the counter reflector is reflected either within the counter reflector or to the reflector before being issued through the light emission window to the exterior. Thus, the risk of glare is reduced.

Preferably, the illumination device is characterized in that the counter reflector is made of acoustically absorbing material. Thus, the favorable property of the illumination device, i.e. being sound absorbing, is maintained. An elegant way to keep the reflector and the counter reflector mutually positioned is by means of a bridging element, which optionally simultaneously could also keep multiple reflector parts and the lamp holding means positioned and form a housing for driver electronics for the light source. A rim of the counter reflector may form part of the border of the light emission window. The counter reflector may be completely or partly provided in the reflector cavity, in which case the counter reflector is located in between the lamp holding means and the light emission window.

In an alternative embodiment to tackle glare, the illumination device is characterized in that the light source is at least one, side emitting LED for issuing light from the light source in a direction transverse to the axis towards the reflective surface. Light is then issued through the light emission window and from the luminaire essentially only in an indirect way, while the necessity of a counter reflector is obviated. The LED can be made side-emitting by means of primary optics integrated in the LED package or alternatively by secondary optics, for example a TIR element or reflectors that redirect the light to the side.

The invention relates further to a luminaire comprising at least a first illumination device, and is characterized in that the luminaire comprises an acoustically absorbing panel with optically reflective surfaces at least one surface of which has a plurality of concave surface elements, the first illumination device forming one of said concave surface elements. Not the whole area of the light emission window of the luminaire needs to be light emitting, but a non-light-emitting part of the light emission window may be used for acoustic purposes only. This non-emitting part may still contain concave curved surfaces to create a uniform appearance in the off-state and to have the acoustical benefits of the curved surface. This non-light-emitting part need not be at the rim, but can, for example, be dispersed between light-emitting parts, or the light emitting parts and non-light-emitting parts may form an interdigitated pattern like a checkerboard, a cross, or something random, etc. An illumination device as such can also be considered to be a luminaire comprising only a single unit of the first illumination device.

In an embodiment, the luminaire comprises the first illumination device with a first reflector for providing a first beam, characterized in that the luminaire comprises integral with the first illumination device at least one further illumination device with at least one further reflector for providing at least one further beam, the further illumination device forming a further one of said concave surface elements. Said first beam and said further beam could substantially have the same shape and/or direction, but alternatively could be significantly different with respect to these characteristics. Hence, an advantageous luminaire is obtained for which desired predetermined light characteristics can be selected relatively easily. Such an illumination system provides a very interesting design feature which may be used to achieve a specific required illumination distribution and aesthetics.

BRIEF DESCRIPTION OF THE DRAWINGS

The invention will now be further elucidated by means of the schematic drawings in which.

DETAILED DESCRIPTION OF THE EMBODIMENTS

Figure 1:
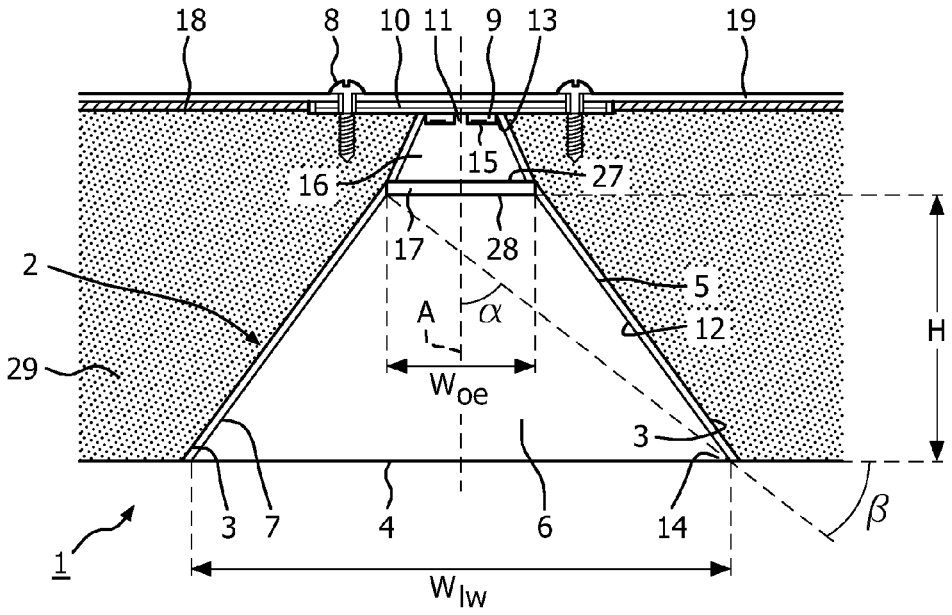
FIG. 1 shows a cross section of a first embodiment of the illumination device according to the invention.

FIG. 1 shows a cross section of a first embodiment of the illumination device 1 according to the invention. The illumination device comprises a concave reflector 2 which borders, with an outer edge 3, on a light emission window 4, the reflector and light emission window constituting a boundary 5 of a reflector cavity 6. The reflector has a reflective surface 7 facing the light emission window. The illumination device further comprises lamp holding means 8 accommodating a light source 9; in FIG. 1 a plurality of white, red, green and blue (WRGB) light emitting LEDs are mounted on a PCB 10 with a light reflective surface 11. In this embodiment, the RGB LEDs do not render the right color for general illumination, but are added to the white LEDs to tune the color. Said PCB and LEDs together are provided in the reflector cavity, i.e. in this particular case form part of the boundary of the reflector cavity. The reflector is acoustically absorbing, diffusely reflective and flame resistant and heat resistant. The reflector is in one piece, tapered and comprises an edge wall 12 connecting a narrow end 13 and a wide end 14 of the reflector. The edge wall is made of sound absorbing foam and coated with GORE™ DRP®, reflector material from Gore, a microporous structure made from durable, non-yellowing polymer PTFE (poly-tetra-fluoro-ethylene). The reflector is diffusely reflective, i.e. about 98.5% diffusely reflective and about 1.5% specularly reflective, rendering the light to be issued from the luminaire as a beam in a direction along an optical axis A. The illumination device is mounted in a housing 18 via which the illumination device is mounted to a deck/ceiling 19. A main part of the spacing 29 between the housing and the edge wall is filled with sound absorbing material. In this embodiment, said spacing and the edge wall are made of one and the same material (for the sake of clarity the edge wall is still indicated by a double line) and hence the edge wall is considered to have a variable thickness. The light source comprises a light-emitting surface 15 facing the light emission window, said light-emitting surface being arranged at the narrow end and being dimensioned substantially equal to the narrow end. The illumination device further has a mixing chamber 16 which is bound by the edge wall, the narrow end and an optical element 17 extending transversely to the axis and provided in between the light source and the light emission window. The optical element is a scattering element, in FIG. 1 a diffuser sheet with a sandblasted side 27 facing towards the light source and a side 28 facing away from the light source. The tapered reflector has at least a height H, H being a dimension measured substantially parallel to the optical axis A of the tapered reflector and transversely to the light emission window. The height H is the distance between the optical element 17 and the light emission window 4, which optical element is considered to be a substitute for the light source 9 as an (imaginary) shifted light source, along the axis A. The illumination device has a glare value, i.e. a value representing the level of glare, which satisfies the European Standard EN 12464 for rooms in which people work intensively with computer displays. The standard specifies requirements to control the average luminance values. For workstations, a maximum limit applies of 1000 cd/m$^2$ for class I and II and 200 cd/m$^2$ for class III of display screen classes according to the ISO 9247-1 classification. This limit applies for cut-off angles $\alpha$ starting from 65° or more. The cut-off angle $\alpha$ is the angle between the axis A perpendicar to the light emission window and the line at which light source and/or surfaces of high luminance are not visible anymore through the light emission window. The glare requirements for rooms in which people work intensively with computer displays pose demands on the illumination device with respect to its dimensions. In particular these demands result in a relationship between the width $W_{lw}$ of the reflector at its wide end 14 (corresponding to the width of the light emission window 4), the width $W_{oe}$ of the reflector at its narrow end 13 (corresponding to the width of the optical element 17) and the height H. This relationship is according to the following equation:

$$\tan(\alpha)<=(W_{lw}+W_{oe})/2H,$$

with $\alpha$ is <=65°

For critical computer screen activities the cut-off area is outside a cone around the axis A, the cone having a top angle of 110°, said top angle being twice the cut-off angle of 55°. The illumination device has a minimum shielding angle $\beta$ of 40°, $\beta$ is the angle between the plane of the light emission window and the first line of sight at which any part of the lamp or its reflection becomes directly visible through the light emission window.

Figure 2:
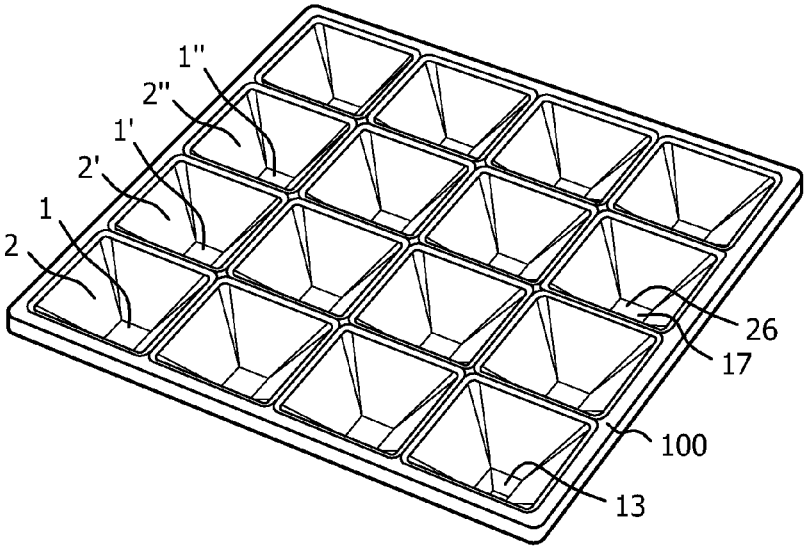
FIG. 2 shows a perspective view of a luminaire in one piece, which is built up of a plurality of illumination devices similar to the illumination device of FIG. 1.

FIG. 2 shows a perspective view of a luminaire 100 in one piece, which is built up of a plurality of illumination devices 1, 1' 1" . . . similar to the illumination device of FIG. 1. The luminaire comprises a first illumination device 1 with a first reflector 2 for providing a first beam and, integral with the first illumination device, at least one further illumination device 1', 1" . . . , in this Fig. fifteen further illumination devices. Each further illumination device has one respective further reflector 2', 2" . . . for providing one respective further beam. The material of the reflectors of the illumination devices' luminaire is a lightweight open cell, thermoformable foam. Adjacent the narrow end 13 of every illumination device but one (to make visible the narrow end 13), an optical element 17 is provided, in the Fig. a plate coated at a side facing the light source with a luminescent material 26, for example YAG:Ce which converts blue light from the light source to light of a longer wavelength. The coated plate partly transmits light from the light source and partly converts light from the light source, the balance between the transmitted light and the converted light being set such that said combination causes the light issued by the luminaire to be white.

Figure 3A:
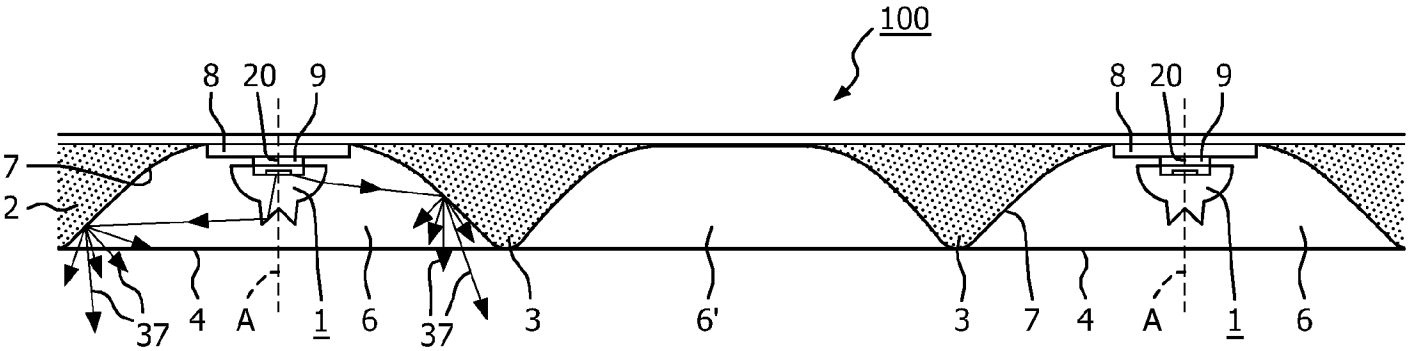
FIG. 3A shows a cross section of a second embodiment of a luminaire comprising a plurality of illumination devices according to the invention.

FIG. 3A shows a cross section of a second embodiment of a luminaire 100 with a plurality of illumination devices 1 according to the invention. Illumination device 1 is a luminaire with a round, cup shaped reflector 2 in one piece, which reflector borders, with an outer edge 3, on a round light emission window 4, the reflector and the light emission window constituting a boundary of a reflector cavity 6. The round reflector has a center 20 through which an axis A extends that coincides with an optical axis of the luminaire and extends transversely to the light emission window. In the center a light source 9 is provided on lamp holding means 8, i.e. a single side-emitting white LED mounted on a PCB, but this could alternatively be a halogen incandescent lamp provided with a mirroring coating on a side of its bulb surface facing towards the light emission window. Said LED issues light in a direction transverse to the axis towards the essentially diffusely reflective surface 7 of the round reflector; "essentially" in this respect means that the reflector is designed so as to be as highly diffusely reflective as possible, meaning that in practice it has a diffuse reflectivity of 93% or more. Light is issued from the luminaire as diffusely scattered light as shown by light rays 37. The reflector is made from sound absorbing material. In the luminaire, the two illumination devices shown are mutually separated by a reflector cavity 6 in which no light source is provided.

Figure 3B:
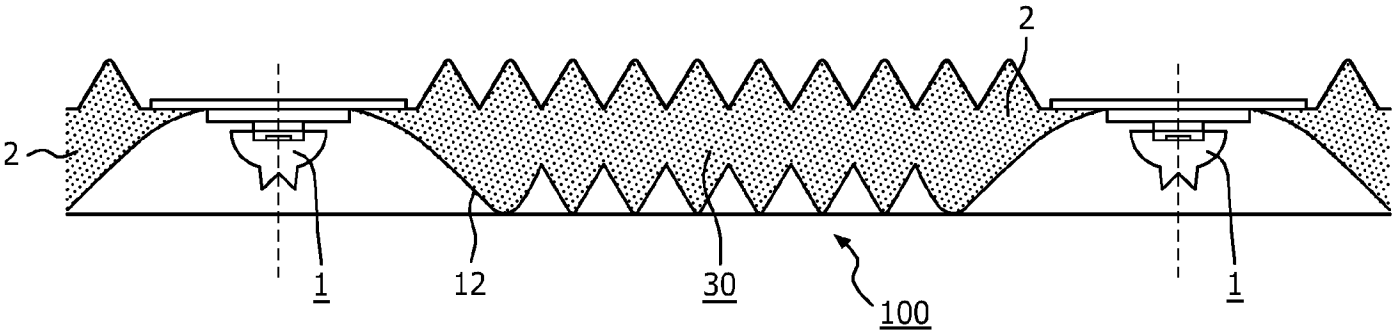
FIG. 3B shows a cross section of a third embodiment of a luminaire comprising a plurality of illumination devices according to the invention.

FIG. 3B shows a cross section of a third embodiment of a luminaire 100 comprising a plurality of illumination devices 1 according to the invention, which is analogous to the luminaire of FIG. 3A, but in which the reflector cavity 6 without light source (see FIG. 3A) is substituted by a wave-shaped sound absorbing and light reflective mass 30 having a saw tooth structure when viewed in cross section. Said reflective mass preferably is of the same material as the material used for the edge wall 12 of the reflector 2.

Figure 4A:
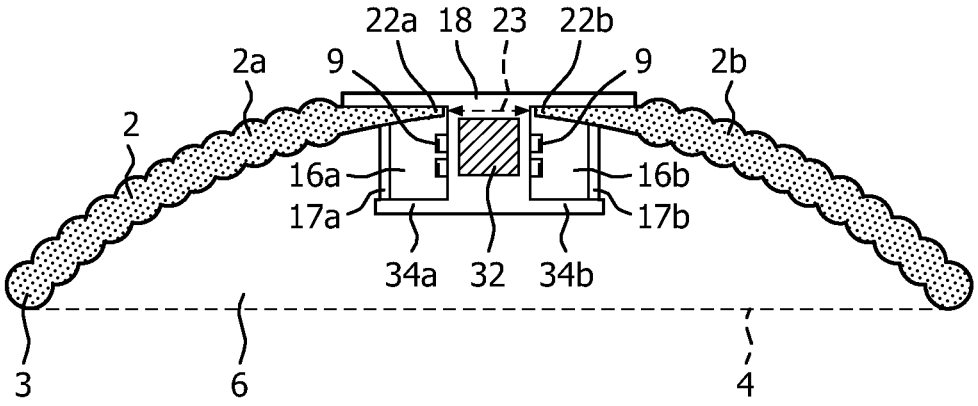
FIG. 4A shows a second embodiment of the illumination device according to the invention.

FIG. 4A shows a second embodiment of the illumination device according to the invention. The illumination device has a reflector 2 composed of two reflector parts 2*a*, 2*b*, i.e. two mirror-positioned elongated concave reflectors parts 2*a*, 2*b*, with undulated surfaces and which are mounted on a centrally positioned, elongated housing 18. The reflector has an outer edge 3 that borders on a light emission window 4. The reflector and the light emission window together constitute a boundary of a reflector cavity 6. Both reflector parts each have a respective inner edge 22*a*, 22*b* at which they are mutually separated by a spacing 23 through which the housing extends and at which they are mounted onto the housing. The housing houses driver electronics 32 for a light source 9. The housing extending through the spacing renders the driver easily accessible from the backside and enables easy connection of the driver electronics of the illumination device to a power supply. The illumination device further has two optical elements 17*a*, 17*b*, fixed in the housing and positioned transverse to the light emission window in the reflector cavity. The optical elements in combination with respective walls 34*a*, 34*b* of the housing, respective reflector parts 2*a*, 2*b*, and the light source 9, jointly forming respective mixing chambers 16*a*, 16*b*.

Figure 4B:
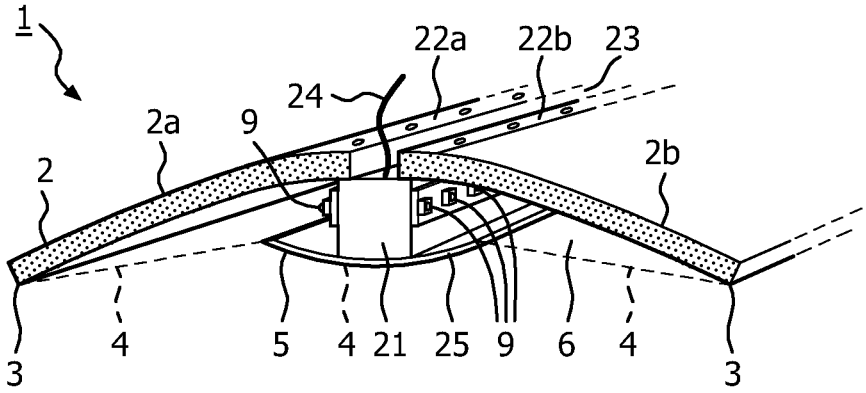
FIG. 4B shows a perspective view of a third embodiment of the illumination device according to the invention.

FIG. 4B shows a third embodiment of the illumination device 1 according to the invention. The illumination device has a reflector 2 composed of two reflector parts 2*a*, 2*b*, i.e. two oppositely positioned elongated concave reflectors parts 2*a*, 2*b* which are mounted on a centrally positioned, elongated bridging element 21. The reflector has an outer edge 3 that borders on a light emission window 4. The reflector and the light emission window together constitute a boundary 5 of a reflector cavity 6. Both reflectors parts each have a respective inner edge 22*a*, 22*b* at which they are mutually separated by a spacing 23 and at which they are mounted onto the bridging element. The bridging element houses driver electronics (not shown) for a light source 9. The spacing between the reflector parts makes the bridging element easily accessible from the backside and enables easy connection of the driver electronics of the illumination device to a power supply, for example via electric cable 24. The illumination device further has a partly translucent, partly reflective counter reflector 25 mounted on the bridging element and positioned opposite the reflector in the reflector cavity. Both the reflector and the counter reflector are made of sound absorbing material. The light source, in the Fig. a plurality of LEDs but a pair of elongated low pressure mercury fluorescent discharge lamps would alternatively be possible, is mounted on the bridging element and is positioned in between the reflector and the counter reflector. Light issued by the light source either impinges on the reflector and is then largely issued from the illumination device to the exterior or impinges on the counter reflector and is then either diffusely transmitted through the counter reflector or reflected to the reflector and subsequently largely issued from the illumination device through the light emission window to the exterior.

Figure 5:
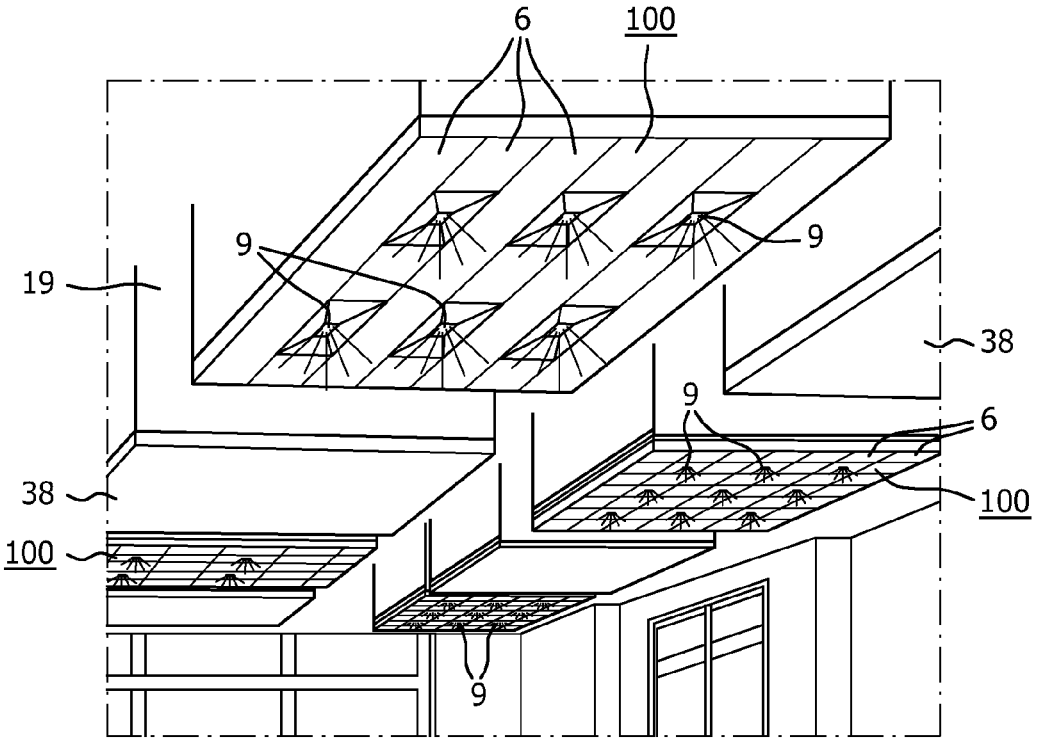
FIG. 5 shows a ceiling with suspended luminaires according to the invention.

FIG. 5 shows a ceiling 19 where some of the conventional acoustic panels 38 that suspend from said ceiling are replaced by luminaires 100 according to the invention. Each of the luminaires comprises a plurality of illumination devices 1 distributed together with non-illuminating reflector cavities 6 over the luminaire.

The invention claimed is:

1. An illumination device comprising:

a pair of concave reflectors each made of a single acoustically absorbing and light reflective element and bordering, with an outer edge, on a light emission window, the pair of concave reflectors and the light emission window constituting a boundary of a reflector cavity, the pair of concave reflectors each having a reflective surface facing the light emission window, wherein the acoustically absorbing and reflective element is sufficiently rigid not to deform due to its own weight, wherein the single element of the pair of concave reflectors is configured to both absorb sound and reflect light in the illumination device, and wherein each of the pair of concave reflectors is attached to a top surface of a centrally positioned, elongated bridging element;

a counter reflector made of a single acoustically absorbing and light reflective element and positioned such that a concave reflective surface of the counter reflector faces the reflective surface of each concave reflector, wherein the single element of the counter reflector is configured to both absorb sound and reflect light in the illumination device, wherein the counter reflector is attached to a bottom surface of the bridging element; and the bridging element configured to accommodate a light source on two opposing sides of the bridging element and being provided at or within the boundary of the reflector cavity in between the counter reflector and the reflective surface of each of the pair of concave reflectors.

2. The illumination device as claimed in claim 1, wherein each concave reflector is diffusely reflective.

3. The illumination device as claimed in claim 1, wherein the single acoustically absorbing and reflective element of either the pair of concave reflectors or the counter reflector is a sound absorbing foam.

4. The illumination device as claimed in claim 1, wherein the single acoustically absorbing and reflective element of the pair of concave reflectors or the counter reflector is flame resistant or heat resistant.

5. The illumination device as claimed in claim 1, wherein each concave reflector is tapered and comprises an edge wall connecting a narrow end of the pair of concave reflectors of width Woe and a wide end of the pair of concave reflectors of width Wlw, a height H of the pair of concave reflectors being a dimension measured substantially parallel to an axis A of the pair of concave reflectors and transversely to the light emission window, to the light emission window, the relationship between Wlw, Woe, and H being according to the following equation:

$$\tan(a)<=(Wlw+Woe)/2H,$$

with a is <=65°.

6. The illumination device as claimed in claim 5, wherein the edge wall is curved for adapting a beam shape of light emitted by the illumination device.

7. The illumination device as claimed in claim 1, wherein the light source is at least one side-emitting LED mounted on a printed circuit board for issuing light from the light source in a direction transverse to the axis towards the reflective surface of each concave reflector.

8. A luminaire comprising at least a first illumination device as claimed in claim 7, wherein the luminaire comprises an acoustically absorbing panel with an optically reflective surface that comprises at least one surface with a plurality of concave surface elements, the first illumination device forming one of said concave surface elements.

9. The luminaire as claimed in claim 8, wherein the reflective surface of each concave reflector of the first illumination device provides a first beam, and wherein the luminaire comprises integral with the first illumination device at least one further illumination device with at least one further reflector for providing at least one further beam, the further illumination device forming a further one of said concave surface elements.

* * * * *